United States Patent [19]

Marion et al.

[11] Patent Number: 4,569,672

[45] Date of Patent: Feb. 11, 1986

[54] AUTOMATIC CUTTING, FOLDING AND PACKING MACHINE FOR SHEETS OF FLEXIBLE MATERIAL WHICH ARE USUALLY PAID OUT IN ROLLED UP WEBS

[75] Inventors: Louis Marion; André Borel, both of Saint.Etienne, France

[73] Assignee: Mabotex, France

[21] Appl. No.: 337,118

[22] Filed: Jan. 5, 1982

[30] Foreign Application Priority Data

Jan. 9, 1981 [FR] France ..... 81 00687

[51] Int. Cl.[4] ..... B31F 7/00

[52] U.S. Cl. ..... 493/359; 493/440; 493/444; 493/937

[58] Field of Search ..... 53/111 R, 117, 120, 53/167, 542, 553; 226/7, 97; 493/418, 440, 444, 937, 450, 235, 236, 356, 359, 360; 474/26

[56] References Cited

U.S. PATENT DOCUMENTS

| | | | |
|---|---|---|---|
| 1,752,415 | 4/1930 | Campbell | 493/444 X |
| 2,268,036 | 12/1941 | Kahn | 493/444 X |
| 2,395,625 | 2/1946 | Heyer | 474/26 X |
| 2,821,386 | 1/1958 | Petre | 493/444 X |
| 3,496,698 | 2/1970 | Wichman | 53/117 |
| 3,640,522 | 2/1972 | Olemann et al. | 493/429 X |
| 3,669,443 | 6/1972 | Noiles | 493/418 X |
| 3,735,551 | 5/1973 | Pratt | 53/553 X |
| 3,745,892 | 7/1973 | Ganz | 493/444 |

FOREIGN PATENT DOCUMENTS

| | | | |
|---|---|---|---|
| 1920863 | 11/1970 | Fed. Rep. of Germany | 53/553 |

*Primary Examiner*—John Sipos
*Assistant Examiner*—Steven P. Weihrouch
*Attorney, Agent, or Firm*—Eric P. Schellin

[57] ABSTRACT

A machine for continuously and automatically cutting, folding and packing sheet material into rolled up webs. The machine is provided with two variable speed drive devices which continuously pulls the sheet material into the machine where it can be cut and folded. The second variable speed drive device comprises a variable speed transmission that operates the folding devices which comprises pivotable plates, folding rollers and the cylinder. The pivotable plates directs the material between the roller and the cylinder by links and levers so that multiple folds may be made in the material. The links and levers are operationally connected to the variable transmission.

17 Claims, 19 Drawing Figures

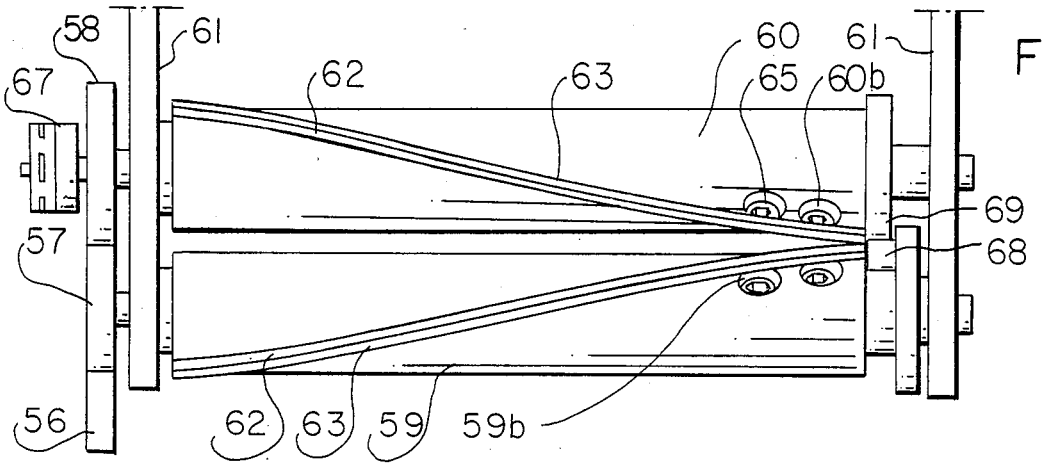
FIG. 11
FIG. 12
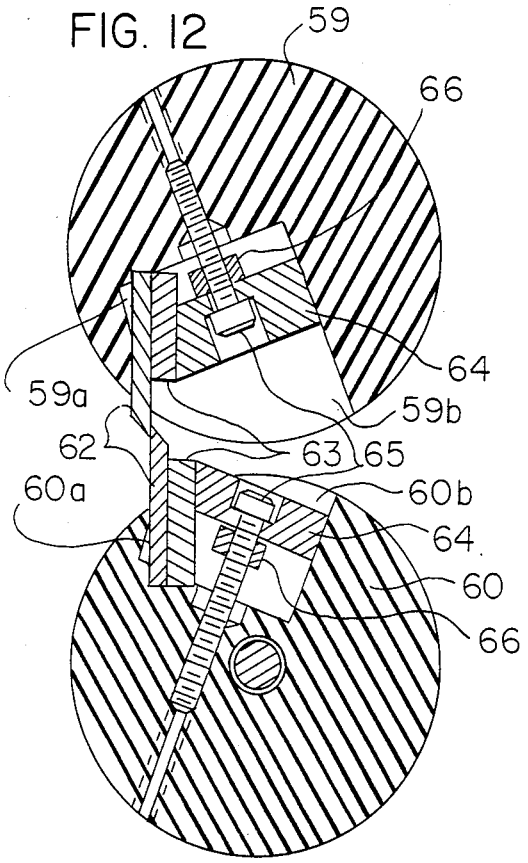
FIG. 13
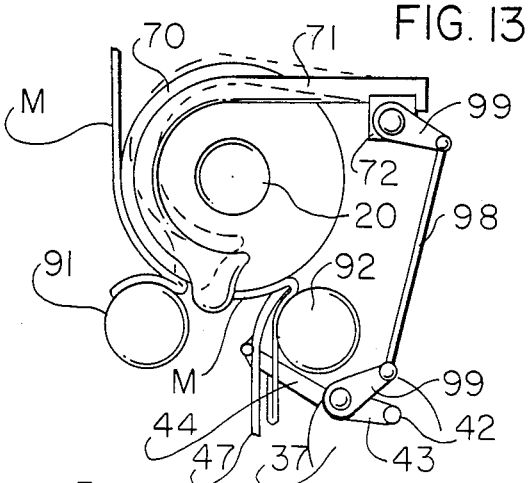
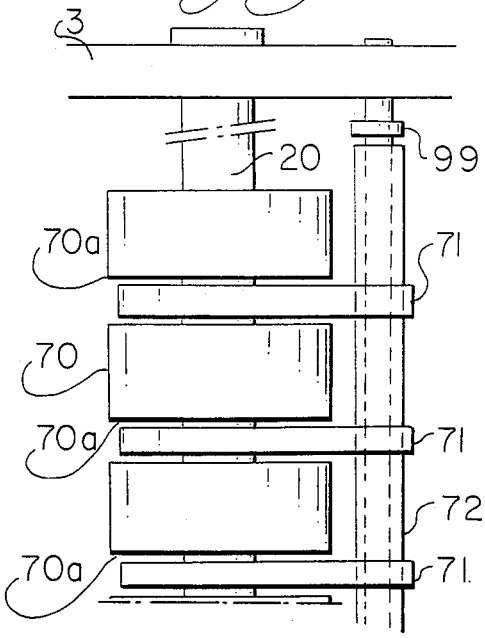
FIG. 14

FIG. 18
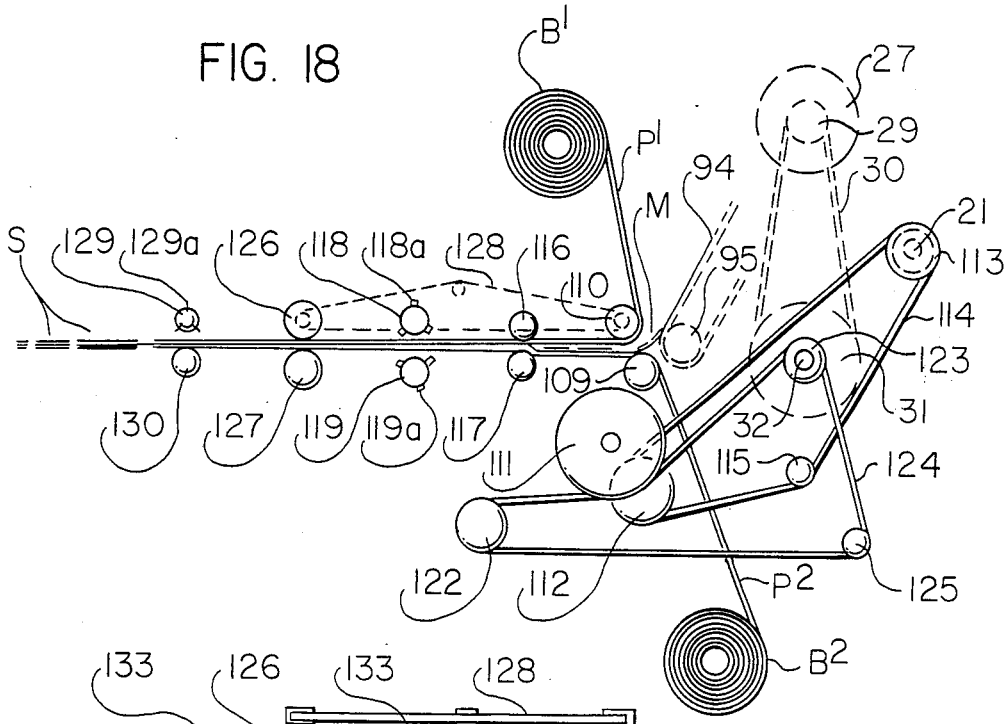
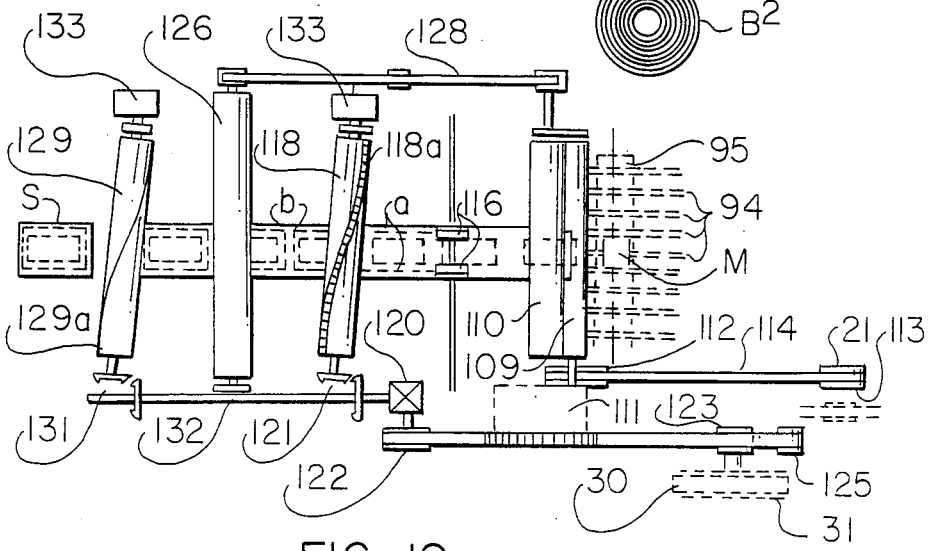
FIG. 19

AUTOMATIC CUTTING, FOLDING AND PACKING MACHINE FOR SHEETS OF FLEXIBLE MATERIAL WHICH ARE USUALLY PAID OUT IN ROLLED UP WEBS

BACKGROUND OF THE INVENTION

1. Field of the Invention

This invention relates to an automatic cutting, folding and packing machine for sheets of flexible material which are usually paid out in rolled up webs.

In accordance with the invention, there has been provided a most efficient machine which is more particularly adapted for textile materials in the woven gauze design or other design, to be used in the manufacture of surgical bandages, however without being restricted to these materials.

2. Description of the Prior Art

The bandages are generally made in the form of rolled up webs. Their packing is performed either directly by packaging rolls of determined length, or by longitudinal and possibly transversal foldings of the webs being cut to the desired lengths, and then packaging the folded webs into bags or boxes.

The efficiency of the machines, devices and apparatus which are currently used for producing these items is not satisfactory as the webs must be cut when the systems are not operating. It will be also clearly apparent that these sudden and frequent stops in the operation are harmful to the product which is subjected to substantial stress.

In accordance with one characteristic of the invention, the rolled up webs of flexible materials are folded, cut and packed continuously on a machine which includes means for positively driving the webs, means for air guiding of the webs toward cutting organs which are working periodically between two of the means for folding the webs along the thickness, and guiding and transfer devices of the folded and cut webs toward storing, stacking and/or bagging devices, all these working stations being controlled in an automatic and adjustable manner by a motor providing the operation of speed gears, transmission means and driving and guiding means for the webs.

These and other characteristics will be apparent from the following description.

BRIEF DESCRIPTION OF THE DRAWING

To make the object of the invention more concrete, without however restricting it thereby, reference will be made to the attached drawings, in which:

FIG. 11 is a plane view showing the organs for cutting the webs.

FIG. 12 is a cross-sectional view on a larger scale which shows the mounting and the positioning of the cutting blades on the supports thereof.

FIG. 13 is a schematic partial view illustrating the means for separating two successive webs during their passage within the machine.

FIG. 14 is a plane view corresponding to FIG. 13, and showing the mounting of the separating means.

FIG. 18 is a front view illustrating schematically an example of automatic bagging of the folded webs, associated with the machine.

FIG. 19 is a plane view corresponding to FIG. 18.

DETAILED DESCRIPTION

To make the object of the invention more clearly apparent, the invention will be now described in a non restrictive form of embodiment as illustrated by the Figures of the drawings.

Figure 5:
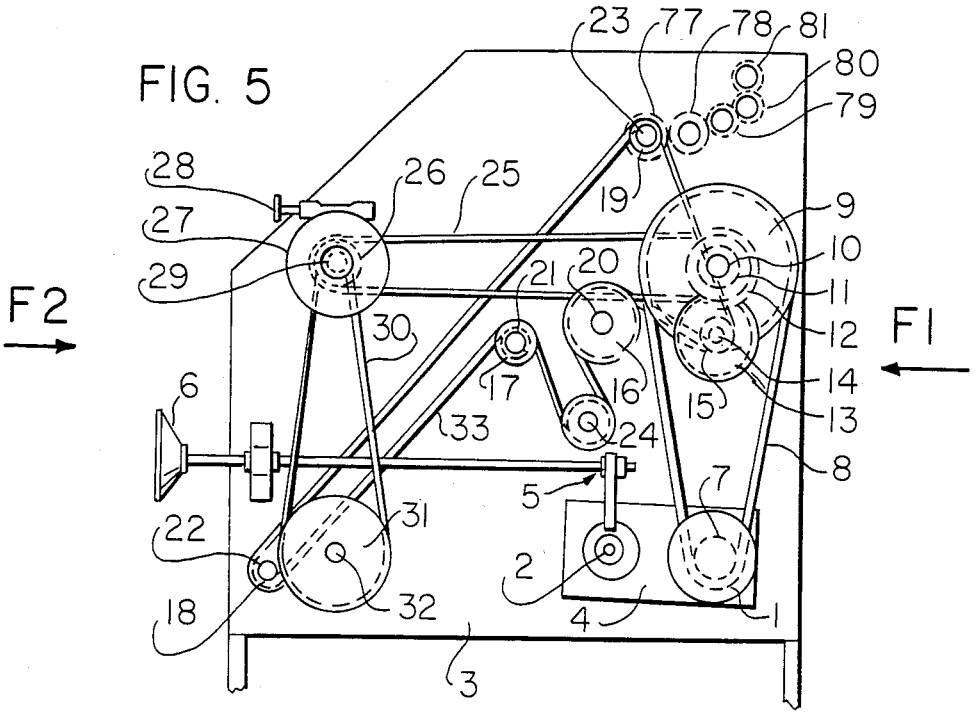
FIG. 5 is a side view of the machine, illustrating the main cinematic chain or line.
Figure 6:
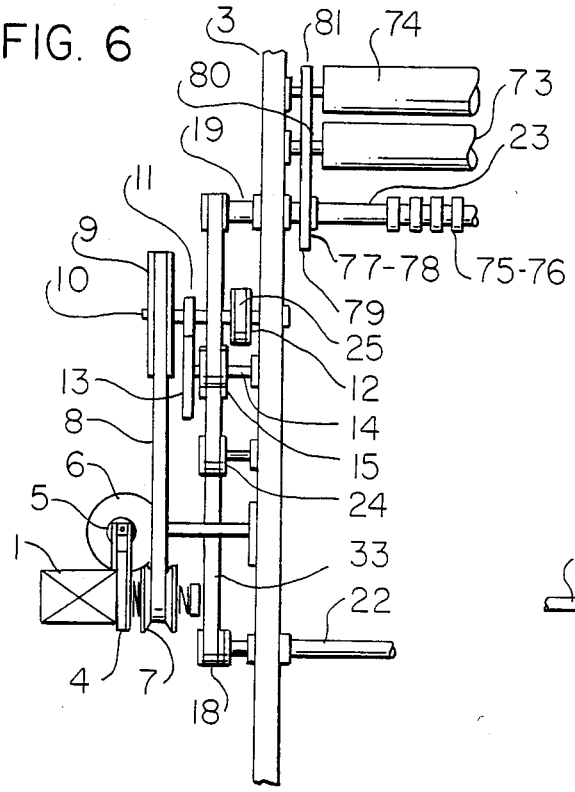
FIGS. 6 and 7 are partial views considered along arrows F1 and F2 of FIG. 5 respectively.
Figure 7:
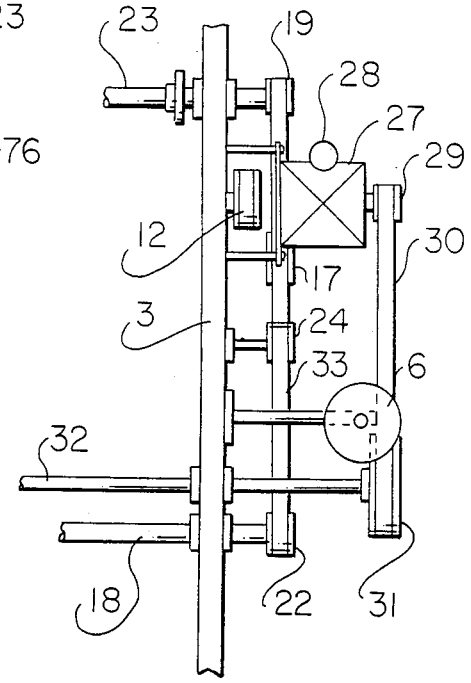
Figure 8:
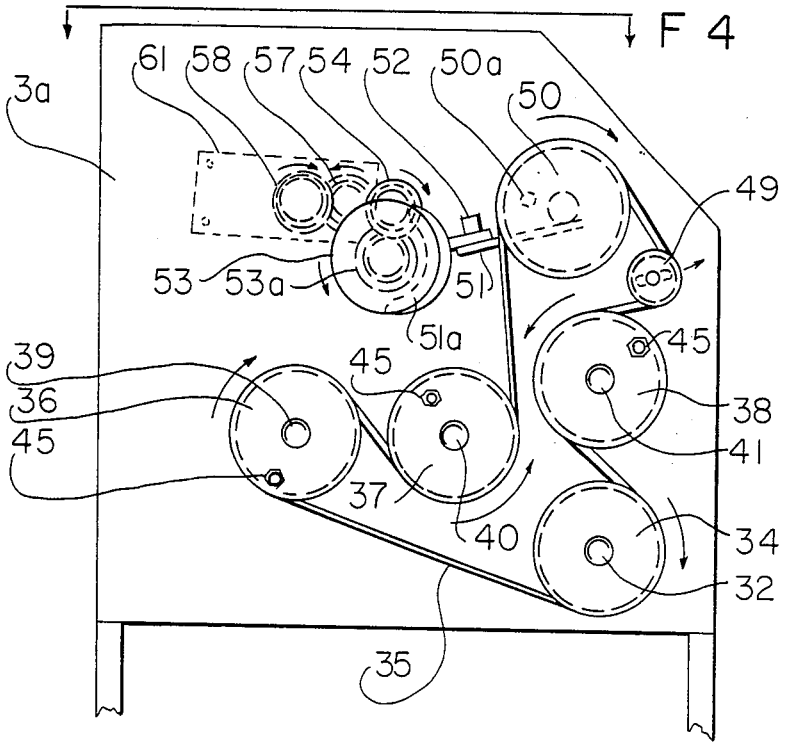
FIG. 8 is a side view of the machine illustrating the cinematic line for the control of the folding and cutting means of the webs.
Figure 9:
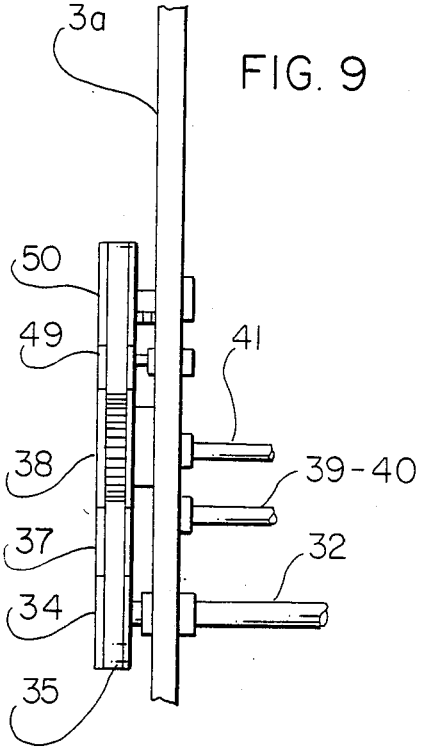
FIGS. 9 and 10 are partial views considered along arrows F3 and F4 of FIG. 8 respectively.
Figure 10:
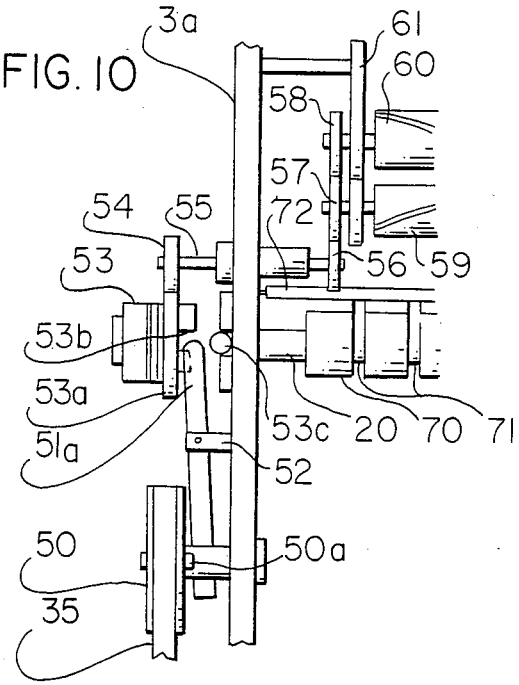

The cinematic line of the machine is described in the first place, as illustrated more particularly by FIGS. 5, 6, 7 on the one hand, and by FIGS. 8, 9, 10 on the other hand, for the two sides of the framework.

The general speed of the machine is given by a motor (1) which is mounted hingedly in (2) on one of the posts (3) of the framework, and supported by a swinging plate (4).

The speed of the motor which is transmitted to the organs of the machine is variable by means of a nut-screw system (5) connected to an operating handwheel (6) to operate a speed change device consisting of a pulley with variable diameter (7) which is wedged to the end of the output shaft of motor (1) and connected by a notched belt (8) to a pulley (9) of larger diameter, which is wedged to a shaft (10) made fast with the upper portion of post (3).

A pinion (11) of small diameter and a pulley (12) are wedged to the same shaft (10). The pinion (11) is meshing with a pinion (13) of larger diameter, which is wedged to a shaft (14) made fast with the post (3) to which is also wedged a pulley (15) which is one of the elements of a motion transmitting assembly consisting of a notched belt (33) which is wound round pulleys (16, 17. 18. 19) wedged to shafts (20, 21, 22, 23) passing through the two posts (3, 3*a*), this assembly being tensioned adjustably by an idler pulley (24).

The pulley (12) wedged to the shaft (10) is connected by a notched belt (25) to a pulley of smaller diameter (26) wedged to the input shaft of a second speed change device (27) with adjusting means (28), made fast with post (3), the output shaft of said device supporting a pulley of small diameter (29) connected by a notched belt (30) to a pulley of larger diameter (31) wedged to a shaft (32) passing through the posts (3, 3*a*). All these elements are clearly apparent from FIGS. 5, 6 and 7 of the drawings.

The shaft (32) receives at the other end thereof remote from post (3*a*) a pulley (34) which is designed to transmit by means of the notched belt (35) the motion given by the shaft (32) to three pulleys (36, 37, 38) rotating round pins (39, 40, 41) secured to post (3*a*).

Figure 2:
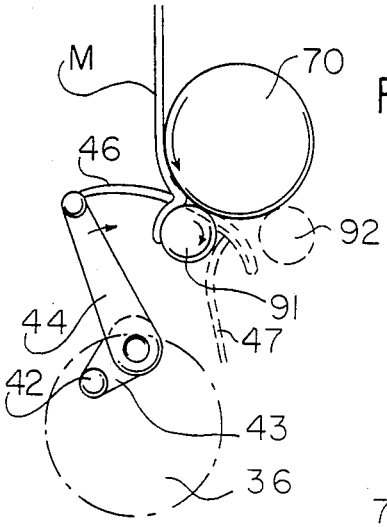
FIGS. 2, 3 and 4 are views on a larger scale, showing schematically the formation of three longitudinal folds on the web.
Figure 3:
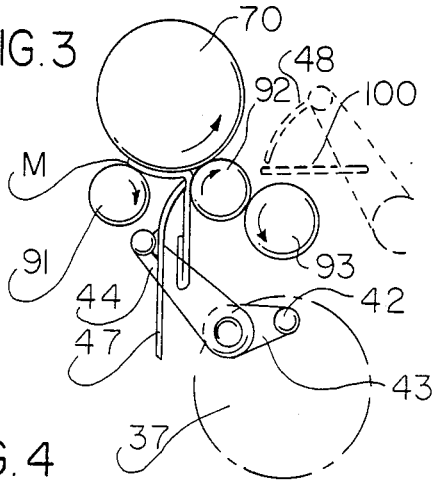
Figure 4:
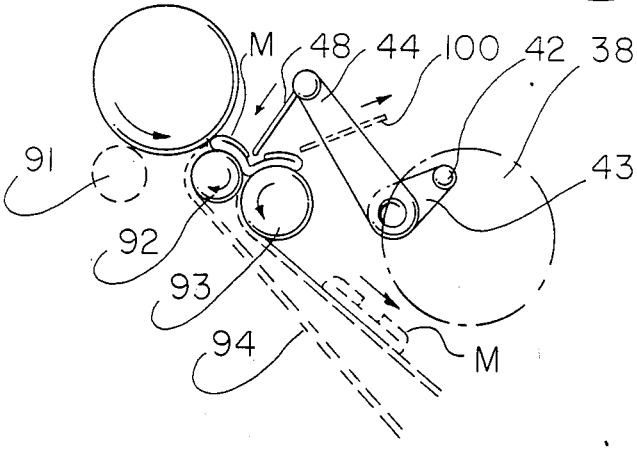

The three pulleys mentioned above have on the inside faces thereof cam-forming hollow profiles to cooperate with rollers (42) or the like supported by levers (43) and links (44) connected to shafts (39, 40, 41), as best seen in FIGS. 2, 3 and 4. The position of the rollers (42) within the cams can be adjusted by means of a sliding gauge (45) to adjust accurately the control in accordance with the folds which are desired in the web of material, and which are performed as described hereinafter by steel sheets or folding devices proper (46, 47, 48) supported at the end of the links (44).

The notched belt (35) is wound moreover round an idler pulley (49) then round a pulley (50) the axis of which is in coincidence with post (3*a*), the inside face of this pulley supporting a boss (50*a*) which is conveniently shaped to pass at each turn beneath a lever (51) linked at (52) to post (3*a*), the other end of this lever being fork-shaped (51*a*) and inserted between two elements of a cone clutch (53), as may be seen from FIGS. 8 and 10.

It will be clearly understood that when the lever (51) is displaced by the boss (50*a*), the clutch (53) is drawn toward the outside of its supporting shaft which is the shaft (20) driven at the other side of the pulley (16).

In this position, it is possible for a pinion (53*a*) of the clutch to mesh with a further pinion (54) supported at one end of a shaft (55) made fast with post (3*a*), the other end of which internally to the two posts receives a further similar pinion (56) which is capable in turn of driving two straight drive pinions (57–58) wedged at the end of two cylinders (59–60) supported by brackets (61) integral with the posts.

The cylinders (59, 60) receive along their whole length flexible cutting blades (62) which are engaged within helicoidal slots (59*a*, 60*a*) of the cylinders, and maintained securedly at the bottom of their slot by helicoidal wedges (63) of the same pitch which are tensioned against the blades by multiple wedge keys (64) housed within chambers (59*b*, 60*b*) of the cylinders and fastened by screws (65) as may be seen clearly from FIG. 12. It will be noted that the screws (65) are passed through nuts (66) made fast with the wedge keys (64) in order to ensure the rising of said wedge keys when dismantling.

One of the two cutting cylinders has internally a prestressed torsion bar the adjusting box of which may be seen in FIG. 11 (adjusting box 67), for maintaining in pressure the blade of said cylinder against the other blade for all the duration of the cutting operation. In the waiting or inactive position of the cylinders (when clutch (53) is not working), the torsion shaft or torsion bar is wedged in rearwardly upon an inside stop. The other cutting cylinder has at one end a roller (68) in contact with a cam (69) of the first cylinder at the beginning of the contact of the two blades (as illustrated in FIG. 11). Afterwards, when the two blades are in continuous contact during all the cutting operation, the roller (68) escapes from the cam.

It will be noted that to make a cut normal to the direction of travel of the webs, it is necessary to cause the cutting cylinders (59, 60) to be slanted longitudinally with a bottom point opposite the blades when they come into contact. On the other hand, the clutch (53) is quickly disengaged and braked at each half-turn through the cooperation of the cut-outs (53*b*) of the pinion with the rollers (53*c*) made fast with post (3*a*) and through the contact of the cones.

As noted above, the clutch (53) is connected to the shaft (20) driven by the pulley (16). This shaft (20) is also supporting between the posts (3, 3*a*) a cylinder (70) with a plurality of grooves (70*a*) for the engagement therein of curved blades (71) integral with a bar (72) pivotally mounted on the posts (FIGS. 13, 14) the purpose of which will be apparent later in the course of the description.

The cylinder (70) forms a part of an assembly of means for driving continuously the webs of material to be cut and folded, the way of travelling of which will be now described with reference more particularly to FIGS. 1–6.

The webs (M) of materials, for instance gauze webs, are generally folded over longitudinally prior to the winding on a bobbin (B). In the contrary case, the longitudinal foldings can be made in a conventional manner by means of folding arms, between the bobbin (B) and the inlet within the machine.

The folded web is driven positively by means of pulling rolls (73–74) in vertical alignment, then by means of pulling rolls (75, 76) in horizontal alignment. The roll (75) is formed on the shaft (23) which is supporting at the end thereof the pulley (19) forming a part of the transmission assembly mentioned previously. This roll is therefore a motive roll, and the motion thereof is transmitted to the rolls (73, 74) on the one hand, and to the roll (76) on the other hand, by means of pinions (77, 78, 79, 80, 81), as illustrated in FIGS. 5 and 6.

Figure 1:
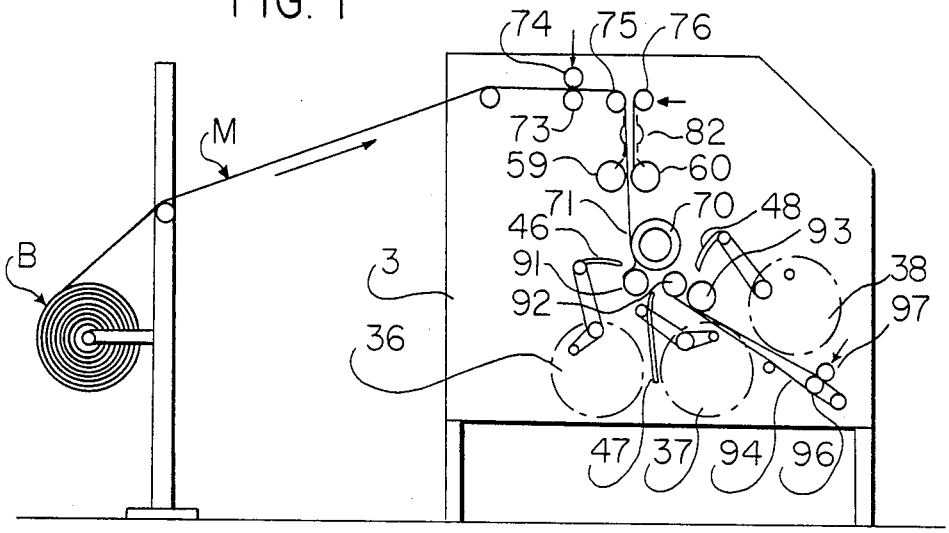
FIG. 1 is a general view of a very schematic character, illustrating the travel of the web of material between the various stations of the machine in accordance with the invention.

It will be noted that the pulling rolls (74, 76) are applied with pressure against the rolls (73, 75) by any suitable means such as eccentric levers symbolized in the drawings by arrows (FIG. 1).

Figure 15:
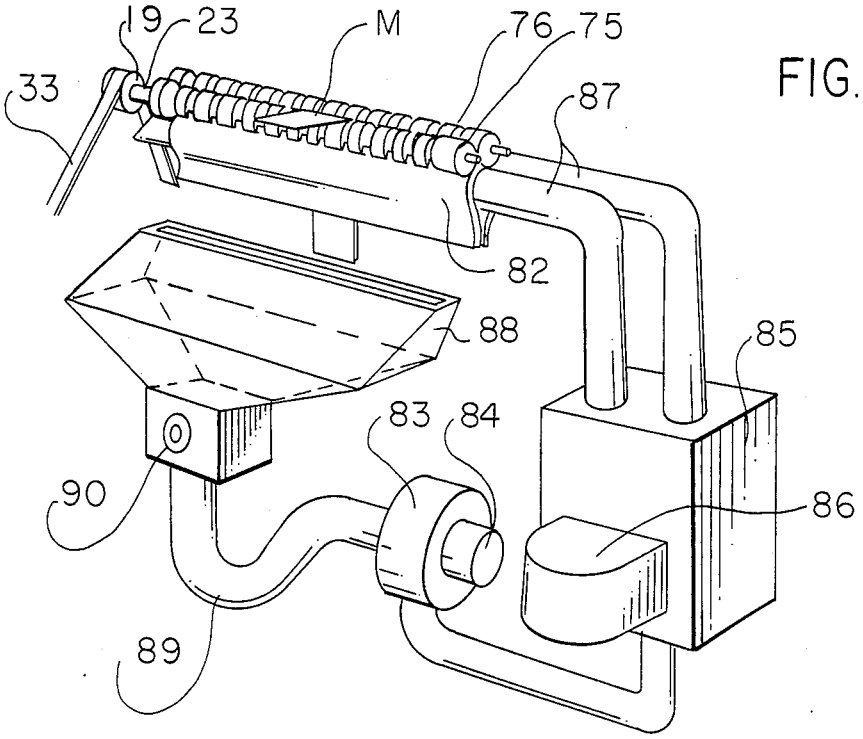
FIG. 15 is a perspective view illustrating the air circuit for guiding the webs.

When so pulled, the web is lowered vertically between the walls of a chamber (82) closely adjacent beneath the rolls (75, 76) so as to prevent the winding of the web round the pulling rolls, and connected to a circuit which is more particularly illustrated in FIG. 15, wherein there may be seen a suction turbine (83) with electric motor (84) which is feeding air into a chest (85) communicating with a humidifying device (86). The humidified air is directed by one or two pipings (87) into the chamber (82), in order to guide the web (M) correctly by a blowing action and also by a suction from the collector (88) positioned below and connected to the turbine (83) through a piping (89). A hygrostat (90) inserted within the suction collector controls the percentage of moisture to be obtained.

The web (M) is then engaged between the cutting cylinders (59, 60) in a waiting position, and is afterwards guided by suitable channels against the cylinder (70) the blades (71) of which are retracted within the grooves (70*a*), as illustrated by dotted lines in FIG. 13.

Smooth rolls (91, 92) are located under a steady contact pressure beneath the cylinder (70), and a third smooth roll (93) is also applied under pressure against the roll (92). From now on, these rolls will be called, respectively: first fold, second fold and third fold rolls.

The web folded along the thickness under conditions which will be described later, is passed between the rolls (92, 93) and is driven and guided upon a carpet loader consisting of conveyor belts (94) wound round the roll (92) and round a lower roll (95). Prior to being discharged out of the carpet loader, the folded bands are passed between two pressure or finisher rolls (96, 97), one of them of which, the roll 96 for instance, is a motive roll by reason of the mounting thereof on the shaft (22) connected through the pulley (18) to the transmission belt (33), the other one, the roll (97), being under adjustable pressure against the first one, for instance by means of an eccentric and lever system, in the same way as for the pulling rolls.

As best seen in FIGS. 2, 3 and 4, the web arriving against the cylinder (70) is applied against this cylinder and the first fold roll (91) by the steel sheet or folder (46) driven from the cam-pulley (36) by the connecting assembly (42, 43, 44). When the first fold is held between the cylinder (70) and the roll (91), the web is cut to the desired length by the cutting blade cylinders (59, 60) actuated by the clutch (53).

Now, prior to the rear of the web ascaping from the first fold roll (91), the web is urged by the second folder (47) against the cylinder (70) and the roll (92) in order to make the second fold (FIG. 3). It will be noted that the next web which is in the process of first fold forming is separated from the preceding web by the projection of the blades (71) controlled from their swinging bar (72) by links and levers (98, 99) articulated on the roll (92) of the second fold (FIG. 13).

The web folded then at the ends extends now on the rolls (92, 93), and is pushed at the centre thereof by the third folder (48) between the rolls (92, 93) to be finally discharged on the conveyor belts (94), as may be seen from FIG. 4.

It is pointed out that the web, when coming out from the second fold, is prevented from being driven by the webs (94) by a receiving plate (100) which is provided above the rolls (92, 93) and is quickly retractable by any means associated with the third folder when the latter is working on the web (FIG. 3).

At the outlet of the conveyor belts (94), the folded webs can be treated in various manners.

Figure 16:
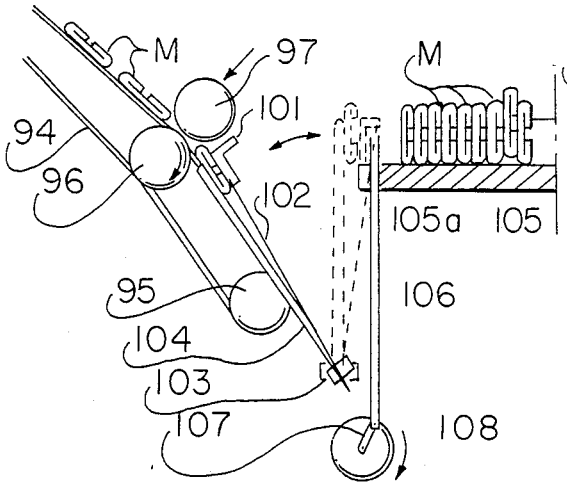
FIGS. 16 and 17 illustrate schematically the stacking means for the folded webs.
Figure 17:
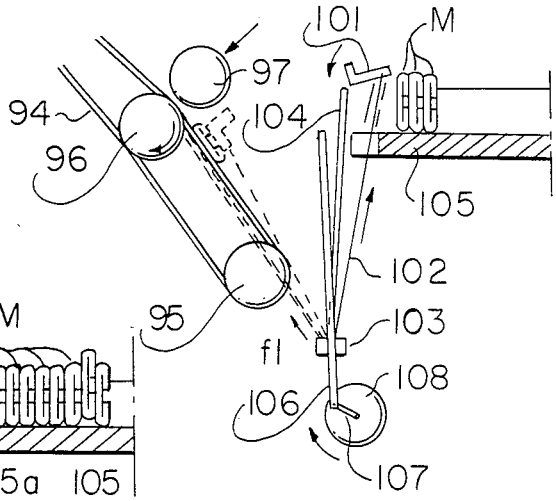

An automatic device for stacking the webs, designed to sort out readily a pre-determined number of webs in view of their packaging, has been illustrated in FIGS. 16 and 17.

It will be seen in these Figures that the folded webs, released from the finisher rolls (96, 97), are held closely on the conveyor belts by a retaining plate (101) articulated on rods (102) mounted for rotation and for controlled sliding on the swinging spindle (103) of a first reed (104) which in the inactive position extends approximately within the travelling direction of the belts up to the vicinity of the roll (96). The reed (104) is controlled by any appropriate means so as to be pivoted about the axis thereof towards a magazine (105) while driving the web folded between this reed and the retaining plate (101), as may be seen in dotted lines in FIG. 16. A second off-set reed (106), hinged by lever and cam (107) to a shaft (108) driven in any known manner, is passed through the castellated ends (105*a*) of the magazine to separate the stack of webs formed within a channel from the web to be laid down. When the first reed (104) arrives at the inlet of the magazine, the second reed (106) pulled by reason of the connection (107) thereof is retracted and is then lifted behind the first reed while hooking when passing the rods (102) of the retaining plate (101) which is pivoted, releasing thereby the folded web (FIG. 17).

The first reed (104) is then returned to the position for gripping a web, while the second reed (106) is positioned again at the inlet of the magazine.

Periodically, an electromagnet and cam device (not shown) associated with a pre-selection meter, is working on the first reed (104) when the latter in the web gripping position in order to displace it slightly upward (arrow $f^1$, FIG. 17) so that this reed will grip sooner the folded web. In this way, the web will be released in upward offsetting within the magazine, delimiting thus readily a stack of webs from the next one in view of the packaging.

In accordance with a further form of embodiment illustrated in FIGS. 18 and 19, the folded and cut webs are directly bagged in an automatic manner. For this purpose, and in continuation to the end roll (95) of the conveyor belts (94), pulling rolls (109, 110) are provided for the upper and lower paper rolls (P1, P2) rolled up in bobbins (B1, B2). The lower pulling roll (109) is driven for rotation by gear train (arrow f2, FIG. 18) from a differential schematized at (111) and connected on one side with the shaft (21) of the third fold through the intermediary of pulleys (112, 113), notched belt (114) and idler pulley (115), while the upper roll (110) is preferably articulated with pressure upon the other one.

It will be understood therefore that the folded and cut webs will be passed between the two paper webs (P1, P2) and then that the whole will travel between upper and lower welding wheels (116) and (117) respectively which are urged under pressure against one another and are intended to weld longitudinally and laterally the two paper webs externally to the webs to be bagged (lines (a), FIG. 19).

It will be noted that when several rows of folded webs are to be bagged, paper strips of larger width are to be provided, while the lower welding wheels (117) have a circular knife which is mounted loosely and has a diameter slightly larger than the knurled face, the upper welding wheels (116) having in alignment a smooth bearing portion so that the paper strips will be cut in the longitudinal direction between each row of folded webs.

The lower welding wheels (117) are driven for rotation from the differential (111) through the intermediary of a gear train (schematized by arrow ($f^3$), FIG. 18), while the upper welding wheels (116) are driven from the lower welding wheels by means of pinions.

The paper strips are then engaged between two welding wheels (118, 119) meshing together, formed each one by a cylinder preferably equipped with three helicoidal and equidistant parts (118*a*–119*a*) for welding transversely along two adjacent lines (b) the paper strips between the folded webs (M), in order to close the bags (S) in front and at the back.

The upper welding wheel (118) is connected to a step by step control (120) with a braking similar to the braking of the clutch (through rollers and notching), said control (120) being in turn connected to the differential (111) and to the drive shaft (32) for the folding cams which is driven by the speed change device (27), this connection being provided by means of pulleys (122, 123), a notched belt (124) and an idler pulley (125).

After the transverse welding wheels, the paper strips are pulled positively by two further pulling rolls (126, 127) urged under pressure against one another, the upper roll (126) being driven for rotation from the pulling roll (110) by a chain transmission (128) or the like.

Finally, the paper strips closed on the four sides are cut between two lines (b) by two cylinders (129, 130) one of which, the upper cylinder (129), is equipped with three equidistant cutting blades (129*a*) disposed helicoidally, and is connected to the differential and to the step by step control by a second idler (131) at the end of the same connecting shaft (132). The lower cylinder (130) is smooth and not driven.

It will be noted that the transverse welding wheels (118, 119) and the cylinders (129, 130) are mounted longitudinally adjustable by means of bearing parts (133) sliding on parallel posts (not shown) for the adjustment of the cut to the selected bag lengths. Moreover, these four elements are slanted transversely relative to the travel of the paper strips at the same angle as the pitch of the helix, in order to provide a transverse knurling and a cut normal to the direction of travel.

It will be noted moreover that a speed is obtained at the output of the differential which is as many times lesser that there are folds to be made in the webs (M), while noting also that the spacing between two folded webs to be bagged is introduced by the ratio given to the control shaft (32) of the folding cams, and that the linear speed of the transverse welding wheels and of the cutting cylinders is equal to the travelling speed of the paper strips.

Lastly, it is possible to provide a stacking device of the bags of the same kind as the stacking device for the folded webs.

It is well understood that the web (M) can be folded as many times as desired along the thickness, it will be sufficient to arrange the organs accordingly.

The advantages are clearly apparent from the description; moreover, there is still to point out the automatic and continous performing of the folding and of the cut of the webs, as well as the automatic packaging, with all the possibilities of adjustment in accordance with the size of the webs, and the efficiency which is obtained with this machine. As an indication, it is possible to multiply by four the production rate as compared with the conventional machines, and this with a quality of work which is much improved, as no harm is caused to the webs by sudden and frequent stops of operation.

The invention is not limited in any way to the use nor to the form of embodiment of the various parts thereof which have been more particularly described, on the contrary, any alternative form of embodiment remains within the scope of the invention.

I claim:

1. An automatic machine for cutting, folding and conditioning sheets of supple materials supplied in rolled bands which is supported in a housing and is of the type comprising band drive means, means for guiding the band flow, band cutting members, means for folding the cut bands, devices for transferring the folded bands and conditioning means to perform the cutting, folding and conditioning of sheets of material of different lengths automatically and continuously, characterized in that the machine comprises two variable speed means:

a first variable speed means for adjusting the production speed and comprises a motor (1) on the housing in an articulated manner so as to be adjusted by a screw/nut system (5), an operating wheel and a variable diameter pulley (7) which transmits the motor's movement to a series of control shafts (14, 20, 21, 22, 23), said series of control shafts comprising a first series of control shafts (22, 23) which rotate first rollers (96, 75) for positively intaking the bands which pass between each of the rollers, associated second rollers (97, 76) mounted with regulatable pressure means for pressing against said first rollers (96, 75) and driven by a series of meshing pinions, one of the first series of control shafts (23) drives via a series of pinions (77, 78, 79, 80, 81) a plurality of vertically aligned rollers (73, 74) which positively take in the bands coming in from a supply reel; and a second variable speed means for adjusting the length of material to be folded and cut and a variable transmission (27) which is integral with an upright (3) of the machine and connected by a first set of pulleys (12, 26) and a first notched belt (25) to a shaft (10) carrying a pulley (9) for connection to the motor (1), the variable transmission is provided with an output shaft one end of which is coupled to and rotated by a second set of pulleys (29, 31) and a second notched belt (30) the other end of the output shaft driven a pulley (34) and a third notched belt (35) for rotating a third set of pulleys (36-38) which are mounted on spindles (39-41) secured to the machine, the third set of pulleys carrying hollow cams, and regulatable position rollers (42) operationally coupled to a folding means comprising levers (43) and links (44) which thereby regulate the pivoting of a plurality of plates (46, 47, 48) which periodically and successively drive the bands between a cylinder (70) and a first folding roller (91) for a first fold, between the cylinder and a second folding roller (92) for a second fold, and between said second folding roller and a third folding roller (93) for a third fold, and that these three rollers and cylinder are put under pressure two by two.

2. Machine according to claim 1, characterized in that one of the control shafts (20) supports the cylinder (70) for driving the bands of material to be folded and cut, the cylinder is provided with a plurality of grooves (70*a*) within which contoured blades (71) are housed and supported by a bar (72) which oscillates between uprights (3, 3*a*) of the machine under the action of links and levers (98, 99) connected to a folding roller (92) in order to separate, by means of the projection of the contoured blades, two successive bands moving through the machine.

3. Machine according to claim 1, characterized in that the third notched belt (35) driven by a first pulley (34) is wound on a second pulley (50) which is centered on the upright (3*a*) of the machine, and the inner face of which carries a contoured boss (50*a*) shaped in such a manner that it moves at each rotation a lever (51) having two ends, the first end is articulated to the upright and the other end (51*a*) is inserted between two elements of a cone clutch (53) mounted on one of the control shafts (20) of the cylinder (70) in order that the clutch pinion (53*a*) meshes with the relay pinions (54, 56) which control, by means of other pinions (57, 58), two cutting cylinders (59, 60) secured to the machine and inclined in relation to the passing of the bands.

4. Machine according to claim 3, characterized in that the disengagement and the rapid braking of the cone clutch (53) is achieved by the combination of the cones and by indentations (53*b*) of the clutch pinion (53*a*) indexed after each rotation in rollers (53*c*) integral with an upright (3*a*) on the machine.

5. Machine according to claim 3, characterized in that each of the two cutting cylinders (59,60) receives a flexible cutting blade (62) over its entire length which is engaged in a helicoidal slot (59*a*, 60*a*) in the cylinders and is held firmly at the bottom of its slot by helicoidal wedges of the same pitch (63) placed under pressure against the blades by a plurality of key wedges (64) housed in recesses (59*b*, 60*b*) and fixed by screws (65).

6. Machine according to claim 5, characterized in that one of the two cutting cylinders comprises on its inside a prestressed torsion bar (67) which can be controlled for keeping the two blades together under pressure during the cutting operation, so that when the cylinders are in a waiting position the torsion bar is wedged against an inner shoulder, and that the blades are put into contact in a progressive manner by the head space of a roller (68) integral with one of the cylinders by means of cam (69) integral with the other cylinder.

7. Machine according to claim 1, characterized in that the band (M) positively taken in by a first roller pair (73, 74) and a second roller pair (75, 76), the band vertically traverses a chamber (82) which is closely coupled in under the second roller pair (75, 76) in order to prevent the band from winding around these rollers, the chamber is connected to an air circuit comprising an intake turbine (83) having an electric motor (84) which sends the air into a chest (85) having a humidifier (86) and the humidified air is directed by at least one conduit (87) into the chamber (82) in order to guide the band, the air in the chamber is withdrawn by a collector (88) having a hygrostat (90) which connected to the turbine by a conduit (89).

8. Machine according to claim 1, by wherein the band (M) arriving against the grooved cylinder (70) is applied between this cylinder and the first folding roller (91) by a first folding sheet (46), in that when the first fold is formed between the cylinder and the first folding roller, the cutting cylinders (59, 60) are actuated by the cone clutch (53) and cut the band to the desired length, the cutting takes place before the rear of the band escapes from the first folding roller (91), a second folding sheet (47) drives the band between the cylinder (70) and the second folding roller (92) in order to form the second fold, and contoured blades on the cylinder (71) separate two successive bands, then the twice folded band is received on a receiving plate (100), which directs the twice folded band in conjunction with a sheet folder (48) between second and third folding rollers to form the third fold between the second and third folding rollers (92, 93).

9. Machine according to claim 1, in which the band (M) is folded three times and then received on a endless conveyor belt (94) wound on an upper roller (92) and on a lower roller (95) which is carried by a second control shaft (22), whereby the band is still pressed by passage between the pressing rolls (96, 97) located between the upper roller (91) and the lower roller (95), characterized in that the bands (M) are automatically stacked in passages of a magazine (105) coupled to the machine by a device comprising a first reed (104) carried by a spindle (103) articulated on the machine and comprising a retaining plate (101) articulated on a rod (102) mounted with controlled rotation and sliding to the spindle (103) in such a manner that when the band is freed from the pressing rolls (96, 97), it is pinched between the first reed (104) and the retaining plate (101), and that when the first reed and retaining plate has pivoted and is located at the entrance to the magazine, a second off-set reed (106) articulated by a lever and cam (107) to a control shaft (108) and extending into castellations (105*a*) on the magazine in order to separate the pile of arriving bands, is retracted in order to rise behind the first reed (104), raising during its passage the rod (102) and therefore the retaining plate (101), thus permitting the release of the arriving band.

10. Machine according to claim 9, characterized in that a device with a cam and an electromagnet associated with a preselection counter periodically acts on the first reed (104) when it is holding the band in order to move its slightly toward one of the pressing rolls (96) so that it will take the band (M) sooner and as a result of this the band will be released into the magazine in a staggered manner, constituting a visible reference mark of the delimitation of the piles to be packaged.

11. Machine according to claim 1, in which the folded bands (M) are directly bagged at the exit of the machine by an automatic device which continuously permits first the passing by of two strips (P1, P2) of paper enveloping the bands supplied by the machine, the strips are then welded in the longitudinal and transversal direction and, finally, the transversal cutting of the paper bands between two bagged bands, characterized in that the paper strips (P1, P2) are supplied by upper (B1) and lower (B2) reels and fed between intake pulling roll (109, 110) which mesh with one another, that the lower pulling roll (109) is put into rotation by gear trains from a differential (111) connected on one side of one of the control shafts (21), that the upper pulling roll (110) is preferably articulated to the other, that the longitudinal welds of the paper bands on the outside of the bands (M) are performed by knurled wheel pairs (116, 117) which mesh together and are put under pressure against each other, and that the lower knurled wheel (117) are put into rotation from the differential (111) by a gear train.

12. Machine according to claim 11, applied to the bagging of several rows of folded bands, characterized in that the lower knurled wheels (117) comprise a circular knife which is floatingly mounted and has a diameter slightly larger than a milled span, while the upper knurled wheels (116) comprise, in alignment, a smooth cylindrical span so as to cut the paper bands longitudinally between each row of folded bands.

13. Machine according to claim 11, characterized in that the transversal welds of the paper strips between each folded band are performed between a second set of knurled wheels (118, 119) which mesh together and are each comprised of a cylinder equipped with preferably three active helicoidal and equidistant portions (118*a*, 119*a*), the upper knurled wheel (118) of the second set of knurled wheels is connected to a step-by-step braking contol (120), which is connected to the differential (111) and to the first control shaft (23) for the folding cams by any appropriate transmission.

14. Machine according to claim 11, characterized in that the paper strips (P1, P2) are closed by four welds and cut in two lines (b) of a transversal weld by a cutting device comprising an upper cylinder (129) equipped with three equidistant cutting blades (129*a*) arranged in a helix and a smooth, non-controlled lower cylinder (130).

15. Machine according to claim 14, characterized in that the second set of knurled wheels for transversal welding (118, 119) and the cylinders for transversal cutting (129, 130) are connected to the step-by-step control by conical idlers (121, 131) carried by a connecting shaft (132).

16. Machine according to claim 14, characterized in that the second set of knurled wheels for transversal welding (118, 119) and the cylinders for transversal cutting (129, 130) are carried by bearings (133) which slide on parallel uprights on the machine in order to adjust the weld and the cut to the desired bag lengths.

17. Machine according to claim 14, characterized in that the second set of knurled wheels for transversal welding (118, 119) and the cylinders for transverse cutting (129, 130) are transversely alligned at an oblique angle in relation to the direction of travel of the paper strips at the same angle as the pitch of their thread lines in order to perform a straight weld and cut.

* * * * *